US009151158B2

(12) United States Patent
Chiappone

(10) Patent No.: US 9,151,158 B2
(45) Date of Patent: Oct. 6, 2015

(54) ROOF BOLT INSTALLATION TOOL

(71) Applicant: Shane Chiappone, Leicester, NY (US)

(72) Inventor: Shane Chiappone, Leicester, NY (US)

( * ) Notice: Subject to any disclaimer, the term of this patent is extended or adjusted under 35 U.S.C. 154(b) by 0 days.

(21) Appl. No.: 14/085,858

(22) Filed: Nov. 21, 2013

(65) Prior Publication Data

US 2015/0139741 A1 May 21, 2015

(51) Int. Cl.
*E21B 10/26* (2006.01)
*E21B 21/015* (2006.01)
*E21D 20/00* (2006.01)

(52) U.S. Cl.
CPC ..... *E21D 20/003* (2013.01); *E21B 10/26* (2013.01); *E21B 21/015* (2013.01)

(58) Field of Classification Search
CPC ... E21B 10/26; E21B 21/015; E21D 21/0086; E21D 20/003
USPC ..... 405/302.1; 175/386, 427, 211
See application file for complete search history.

(56) References Cited

U.S. PATENT DOCUMENTS 2,590,958 A 4/1952 Goodrich
2,792,199 A * 5/1957 Becker et al. ..... 175/211
2,828,108 A * 3/1958 Hood et al. ..... 175/211
2,964,115 A * 12/1960 Clatfelter ..... 175/40
3,339,435 A * 9/1967 Walter-Helmut ..... 175/211
3,834,470 A * 9/1974 Gyongyosi et al. ..... 175/211
3,934,661 A * 1/1976 Sauerwein et al. ..... 175/211
3,936,213 A * 2/1976 Kappel ..... 175/211
4,081,041 A 3/1978 Perri et al.
4,105,081 A * 8/1978 Perraud ..... 175/122
4,182,424 A * 1/1980 Prebensen ..... 175/211
4,300,642 A * 11/1981 Perraud ..... 175/173
4,372,401 A * 2/1983 Fischer ..... 175/209
5,934,855 A 8/1999 Osterle et al.
6,814,527 B1 11/2004 Fleming
7,708,087 B2 5/2010 Stables et al.
7,726,417 B2 * 6/2010 Larsson ..... 175/211
8,052,353 B2 11/2011 Oldsen et al.
2008/0251296 A1 * 10/2008 Stables et al. ..... 175/320
2010/0218999 A1 * 9/2010 Jones et al. ..... 175/413

* cited by examiner

*Primary Examiner* — Frederick L Lagman
(74) *Attorney, Agent, or Firm* — Harris Beach PLLC; Neal L. Slifkin

(57) ABSTRACT

The invention provides a roof bolt installation tool which has a central drill bit. A plate surrounds the central drill bit and has radial drill bits attached to it so that when the central drill bit rotates, the plate rotates. A boot surrounds the plate and is rotationally isolated from the plate and central drill bit. When the drill bit cuts a central bore into a mine roof, the radial drill bits cut a recess having a horizontal surface. A roof bolt and support plate are installed such that the bolt is inserted in the central bore and the support plate abuts the horizontal surface.

5 Claims, 10 Drawing Sheets

ROOF BOLT INSTALLATION TOOL

FIELD OF THE INVENTION

The present invention relates to a tool for installing a mine roof support and, more particularly, to a tool for installing a mine roof support including roof bolt and a domed support plate having a dome on one side and a flat surface on the other side.

BACKGROUND OF THE INVENTION

In mine work, such as salt or coal mining, or in underground construction, such as tunnels or other excavations, it is necessary to support the roof of the excavation to prevent cave-ins. Among the most common means presently in use for effecting such support are roof bolts, which are inserted into bore holes and hold a metal support plate against the roof surface.

Prior art reveals two types of roof bolt installations. In the first, the support plate is installed dome-side facing the floor and the flat-side against the roof surface. The installation suffers from a serious drawback. The roof surface is generally not horizontal, but has undulations in its surface. The support plate is therefore not flush against the roof, and provides less than optimal support. When the plate is not horizontal, stresses on the support plate and bolt are uneven, resulting a weaker support system, and possible failure of the plate or bolt. Also, in some mines the strata shift horizontally. When the surface of the roof in the vicinity of the plate is uneven, there is a greater chance that horizontal shifting will cause bolt failure by preventing movement of the bolt.

In the second, as shown in U.S. Pat. Nos. 8,052,353 and 7,708,087, the disclosures of which are hereby incorporated by reference, a concave surface is drilled into the roof and the domed-side of the support plate is inserted into the concave recess. This installation method provides less than optimal support. The dome in the support plate provides structural integrity to the support plate. However, when the dome is facing the roof, there is a greater chance that the vertical pressure on the support plate will crush the dome.

A roof bolt installation tool and installation method is needed which overcomes these deficiencies of the prior art.

BRIEF SUMMARY OF THE INVENTION

A roof bolt installation tool includes a central drill bit. A plate surrounds the central drill bit and has radial drill bits attached thereto such that when the central drill bit rotates, the plate rotates. The plate can include radial arms and the radial drill bits can be removably attached to the radial arms. In one embodiment, the radial drill bits are attached to the radial arms by C-clips.

A boot surrounds the plate and is rotationally isolated from the plate and central drill bit. The boot can be made from flexible material such as rubber. The boot can be rotationally isolated from the drill bit such that it does not rotate when the drill bit rotates. One method of rotational isolation is through the use of a bearing. In one embodiment, a base plate is beneath the plate and the boot attaches to the base plate by bolts, although other attachment methods are available.

A roof bolt and support plate can be installed by drilling a substantially vertical center hole into the mine roof. Simultaneously, a substantially horizontal recessed surface is cut in the mine roof. The roof bolt and support plate are installed into the mine roof such that the roof bolt is substantially vertical. The flat surface of the support plate contacts the mine roof and is substantially horizontal. The bolt head does not project beneath the mine roof in the vicinity of the recessed surface.

BRIEF DESCRIPTION OF THE SEVERAL VIEWS OF THE DRAWINGS

The foregoing and other objects, features, and advantages of the invention will be apparent from the following drawings and more particular description of the preferred embodiments of the invention.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the disclosure. Accordingly, the specification and drawings are to be regarded as illustrative rather than restrictive. It is to be further noted that the drawings are not to scale.

Figure 1:
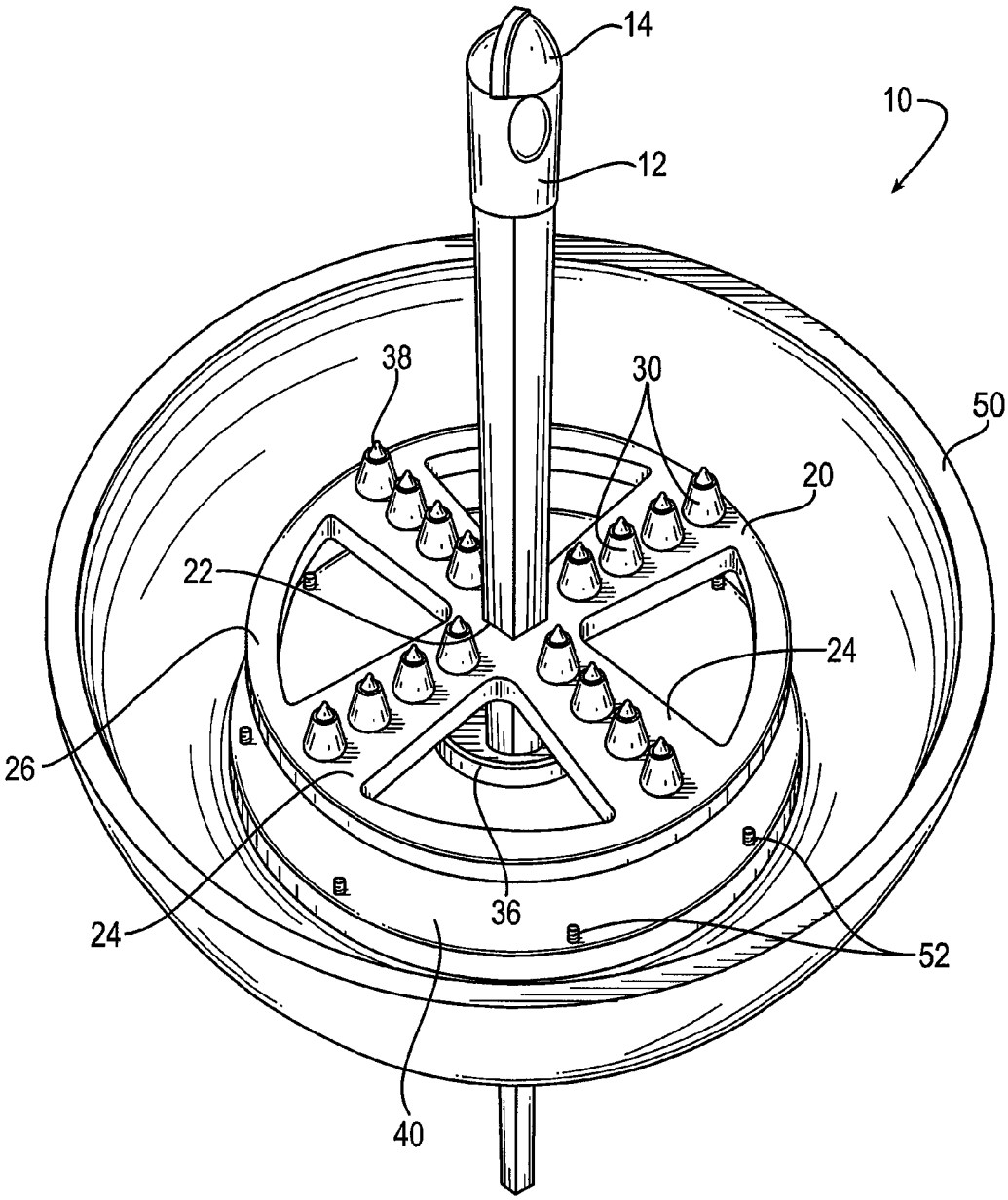
FIG. 1 is a perspective view of the present invention.
Figure 2:
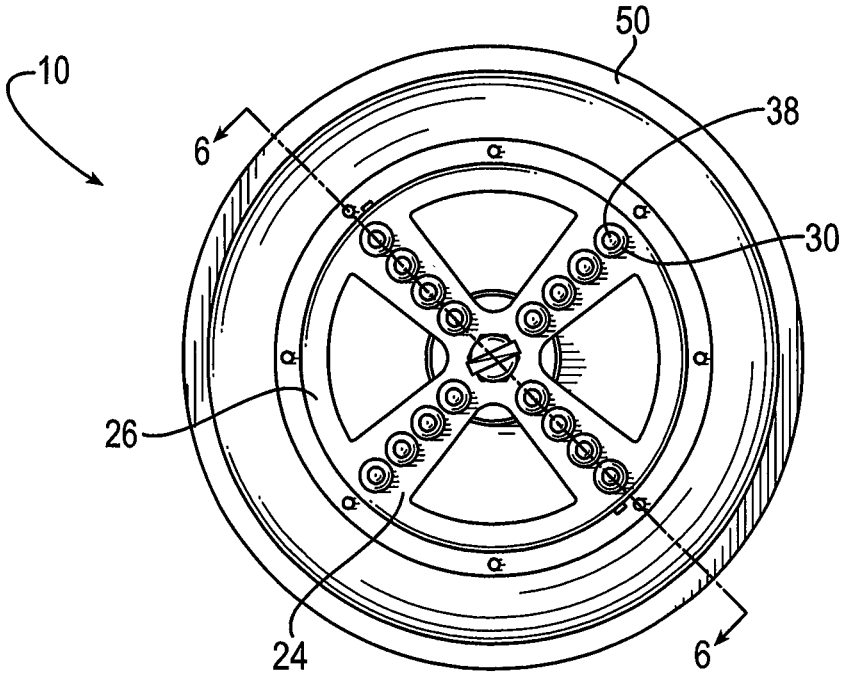
FIG. 2 is top plan view of the invention of FIG. 1.

FIGS. 1 through 11 illustrate the invention. In FIGS. 1 and 2, the roof bolt installation tool 10 includes a drill bit 12, with a bit head 14. A plate 20 includes a central aperture 22 through which the drill bit 12 extends. Radial arms 24 extend from the central aperture 22. A ring 26 connects the radial arms 24. Those of ordinary skill in the art will understand that other configurations of the plate 20 are possible. For example, the plate 20 could be a solid disk.

Figure 3:
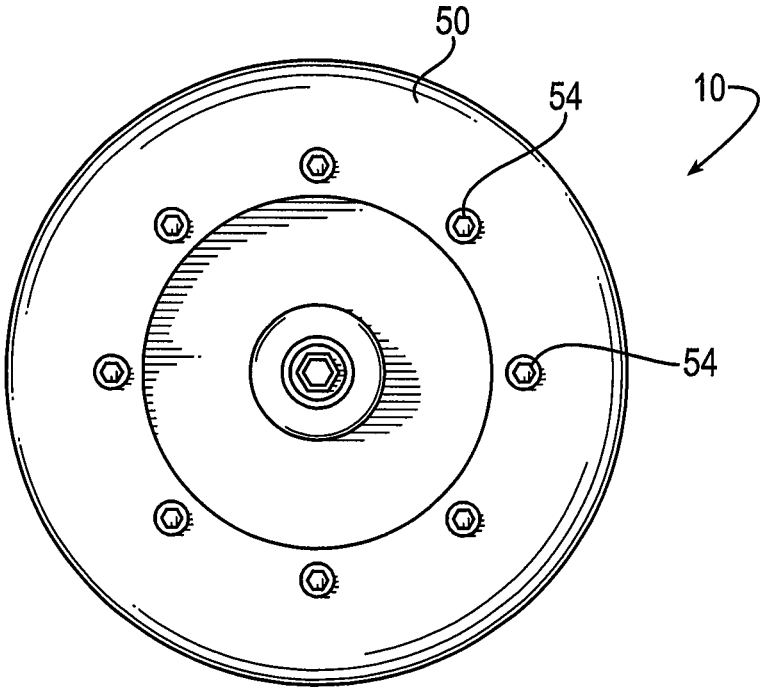
FIG. 3 is bottom plan view of the invention of FIG. 1.
Figure 4:
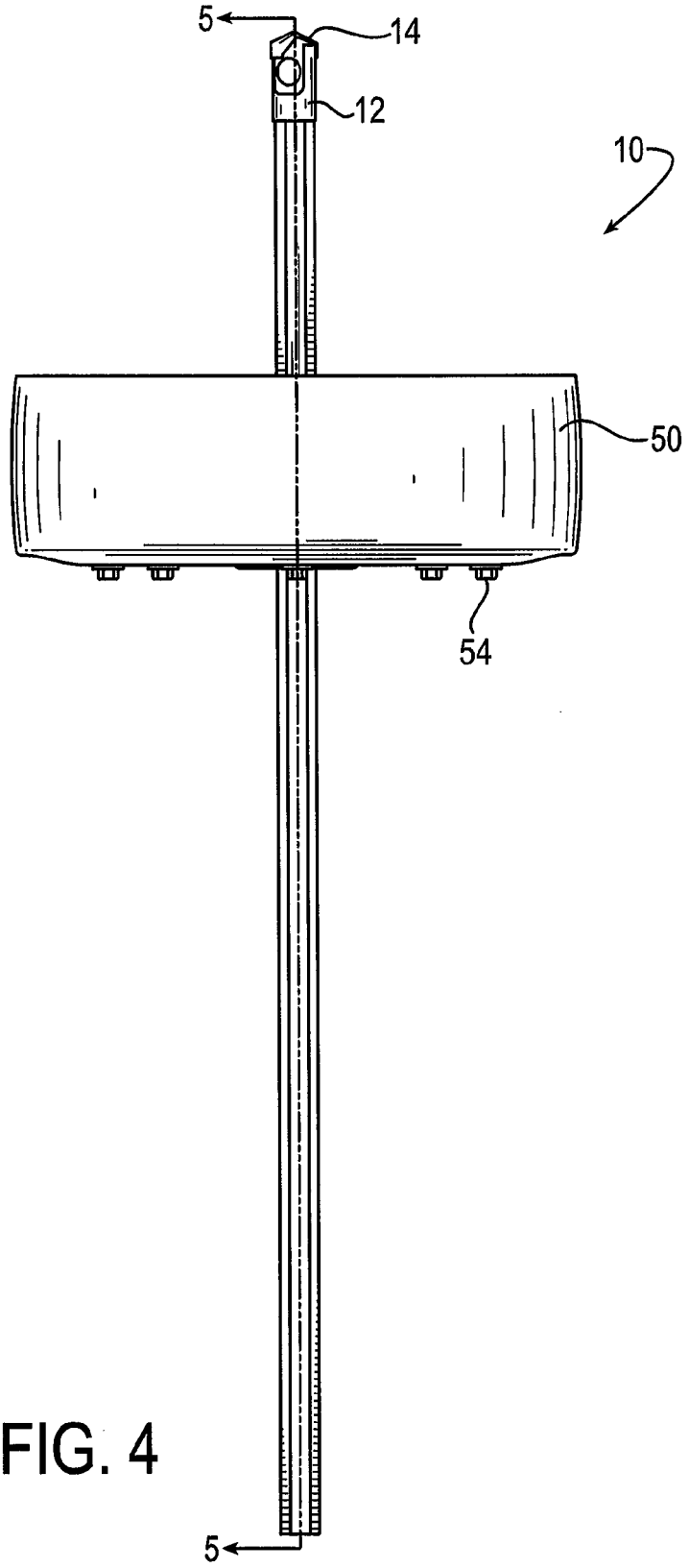
FIG. 4 is side elevation view of the invention of FIG. 1.
Figure 5:
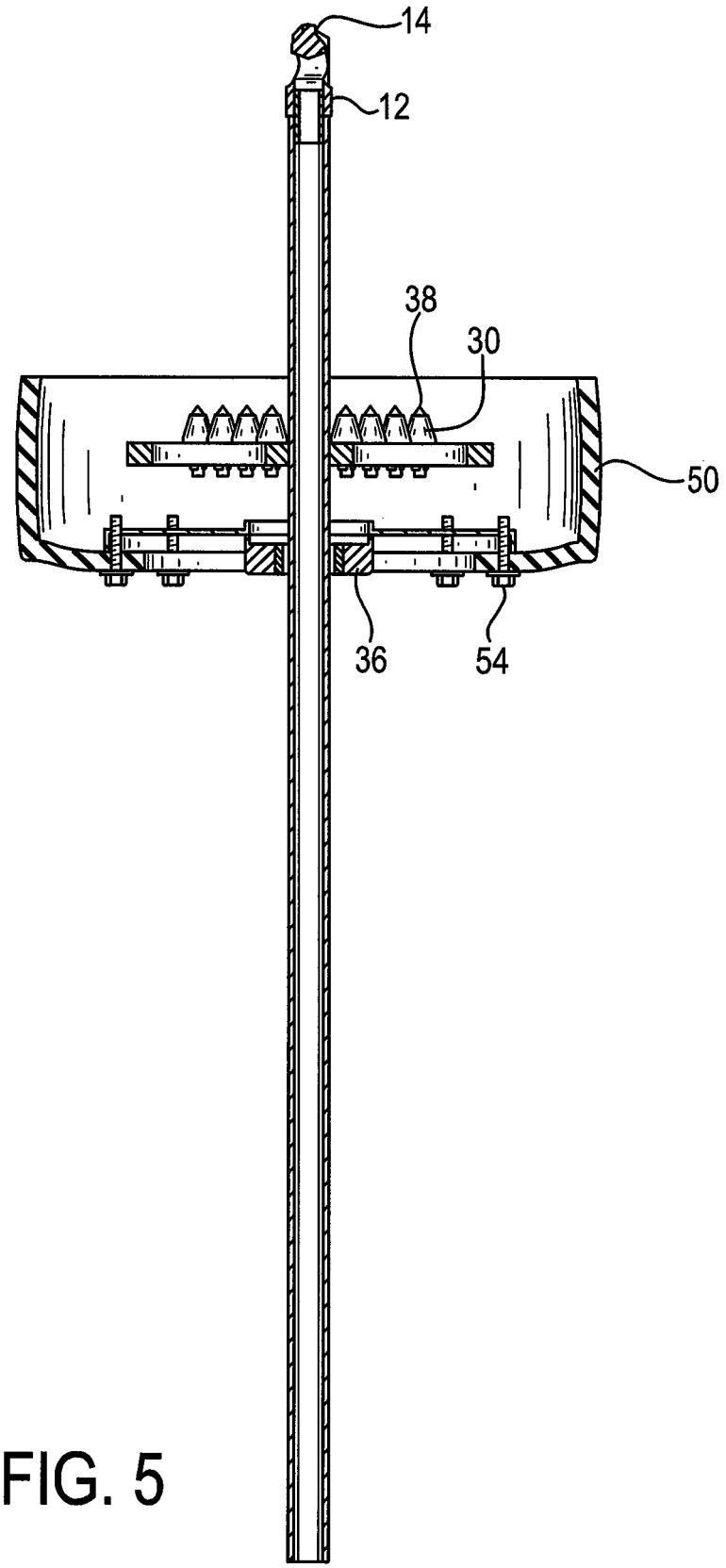
FIG. 5 is a cross-sectional view of the invention of FIG. 1 taken along the line of 5-5 in FIG. 4.
Figure 6:
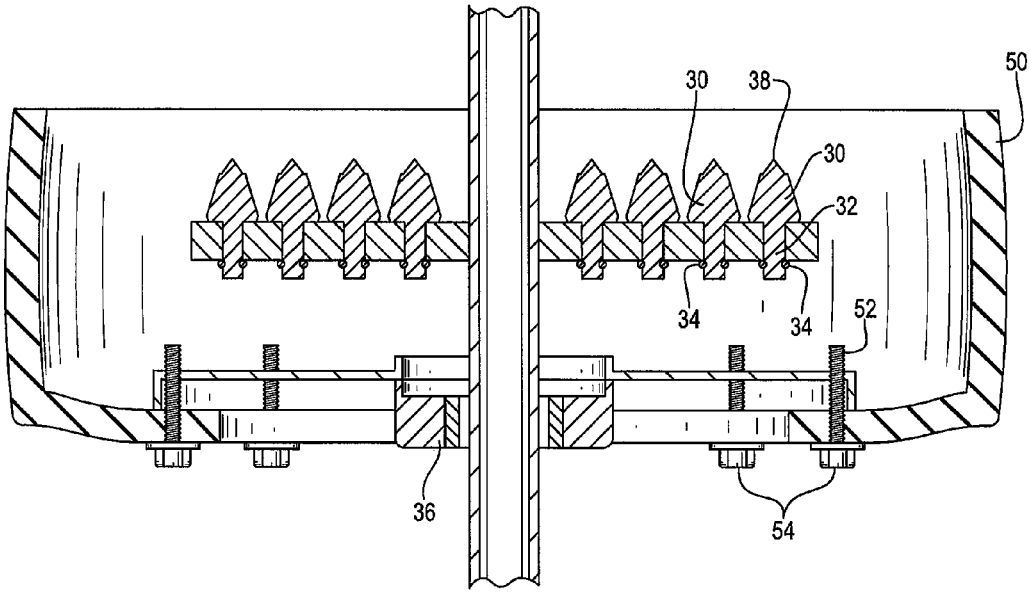
FIG. 6 is a cross-sectional view of the invention of FIG. 1 taken along the line of 6-6 in FIG. 2.

Radial bits 30 are attached to the radial arms 24. The radial drill bits 30 have cutting tips 38 which are in substantially the same plane as one another so that they cut a substantially planar surface. A base plate 40 is spaced apart from the plate 20. The base plate 40 and the plate 20 are rotationally isolated from one another by a bearing 36. A boot 50 is attached to the base plate 40 by bolts 52. Those of ordinary skill in the art will understand that other attachment methods are possible. The bolt heads 54 of bolts 52 are shown in FIGS. 3 and 4. FIGS. 5 and 6 illustrate the bolts 52 and bolt heads 54, and the radial bits 30. The radial bits 30 have shafts 32 which project through the radial arms 24. The shafts 32 of the radial bits 30 have C-clips 34 surrounding the shafts 32 to hold the bits 30 in place in the radial arms 24. The radial bits 30 may be removed and replaced by removing the C-clips 34 and pulling the radial bits 30 out of the radial arms 24. Other attachment methods are within the skill of those of ordinary skill in the art.

Figure 7:
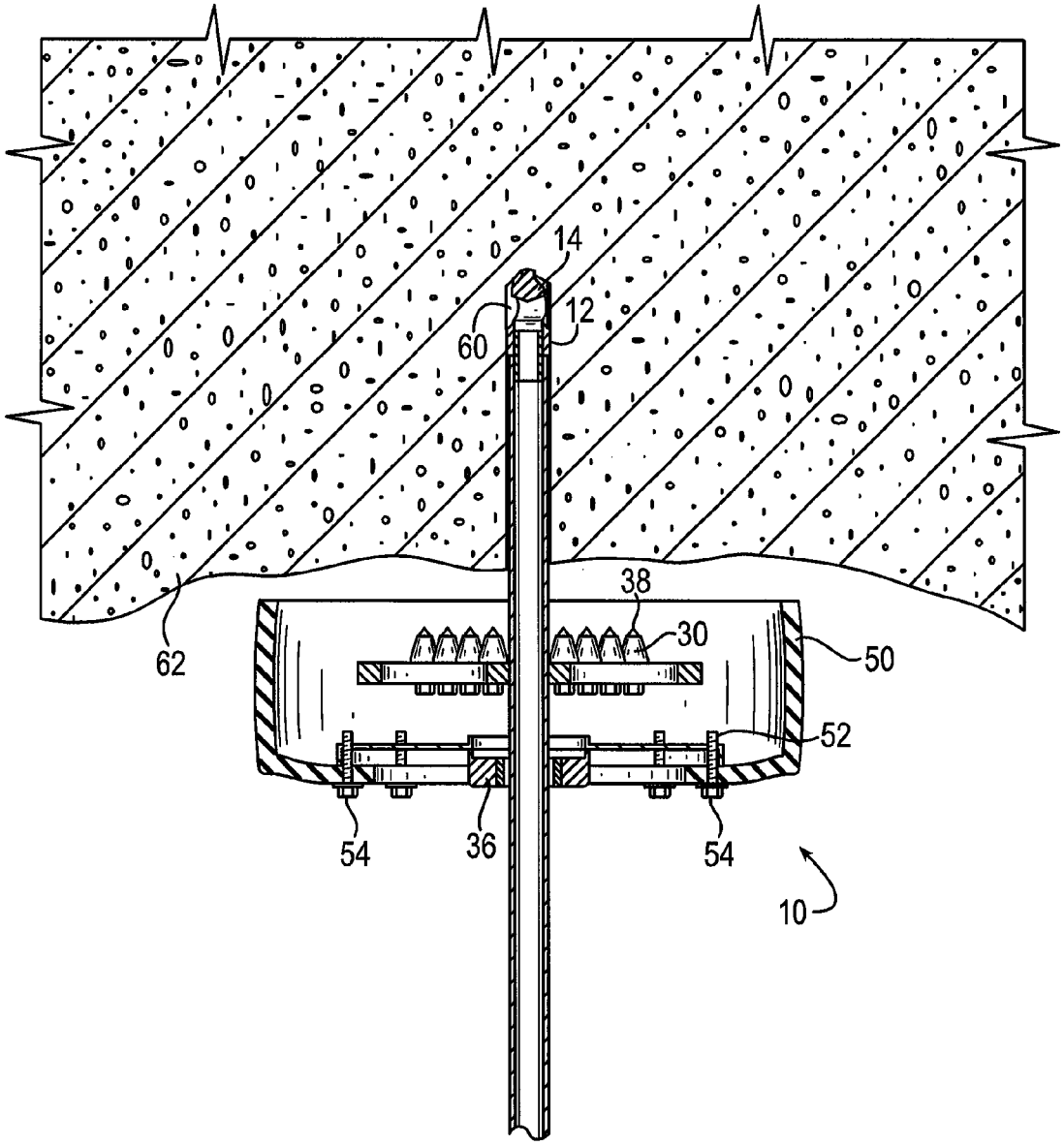
FIG. 7 is a cross-sectional view of the invention of FIG. 1 showing the tool of the present invention in use.
Figure 8:
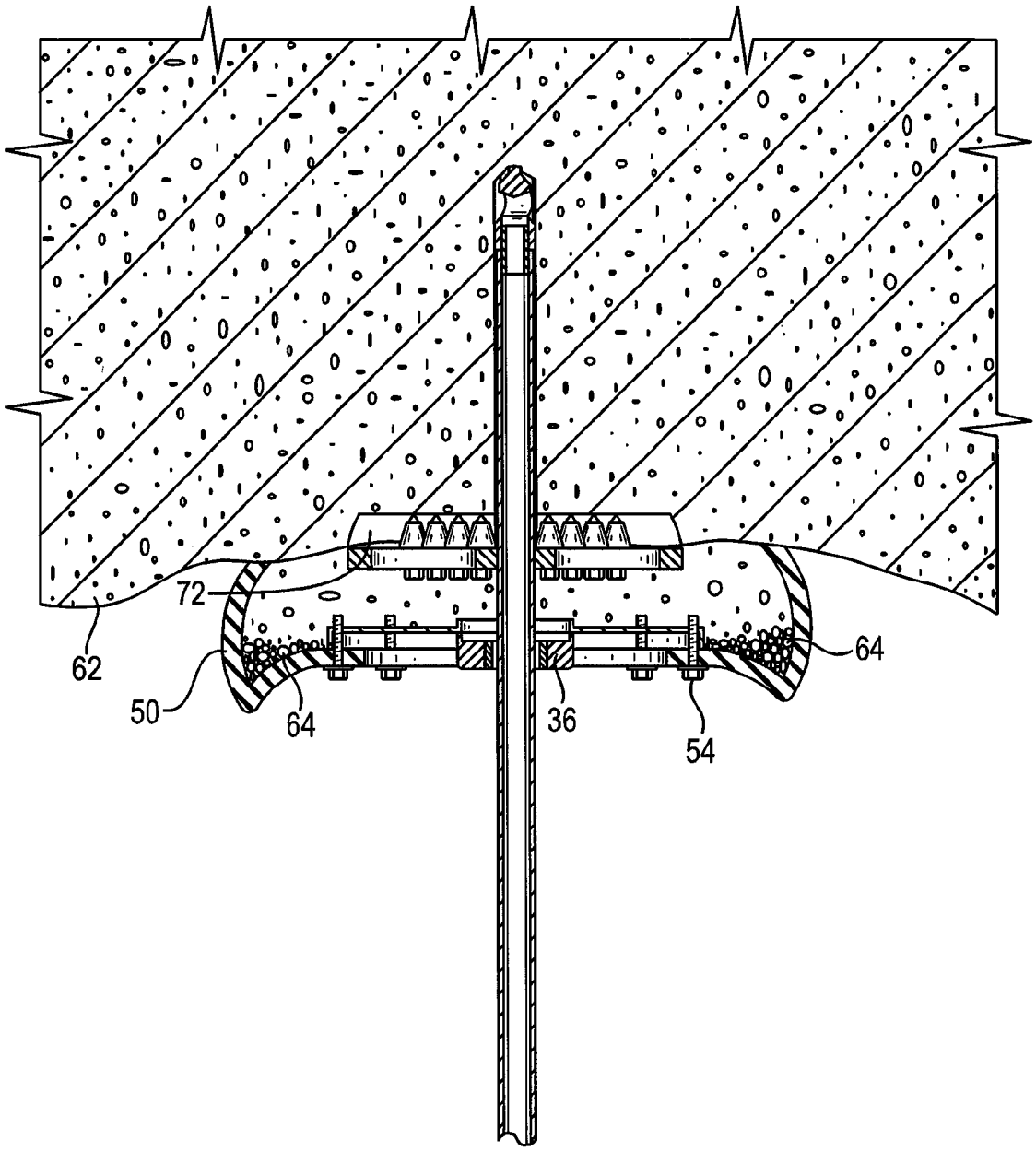
FIG. 8 is a cross-sectional view of the invention of FIG. 1 showing the tool of the present invention in use.

FIGS. 7 and 8 illustrate the roof bolt installation tool 10 in operation. The drill bit is used to cut a bolt bore 60 into the mine roof 62. As the roof bolt installation tool 10 moves up in the vertical direction, as shown in FIG. 8, the radial drill bits 30 cut into the mine roof 62. The boot 50 deforms to allow for the vertical progress of the drill bit 12 and the radial bits 30. The boot 50 catches pieces 64 of the mine roof 60, which have been removed by the radial bits.

Figure 9:
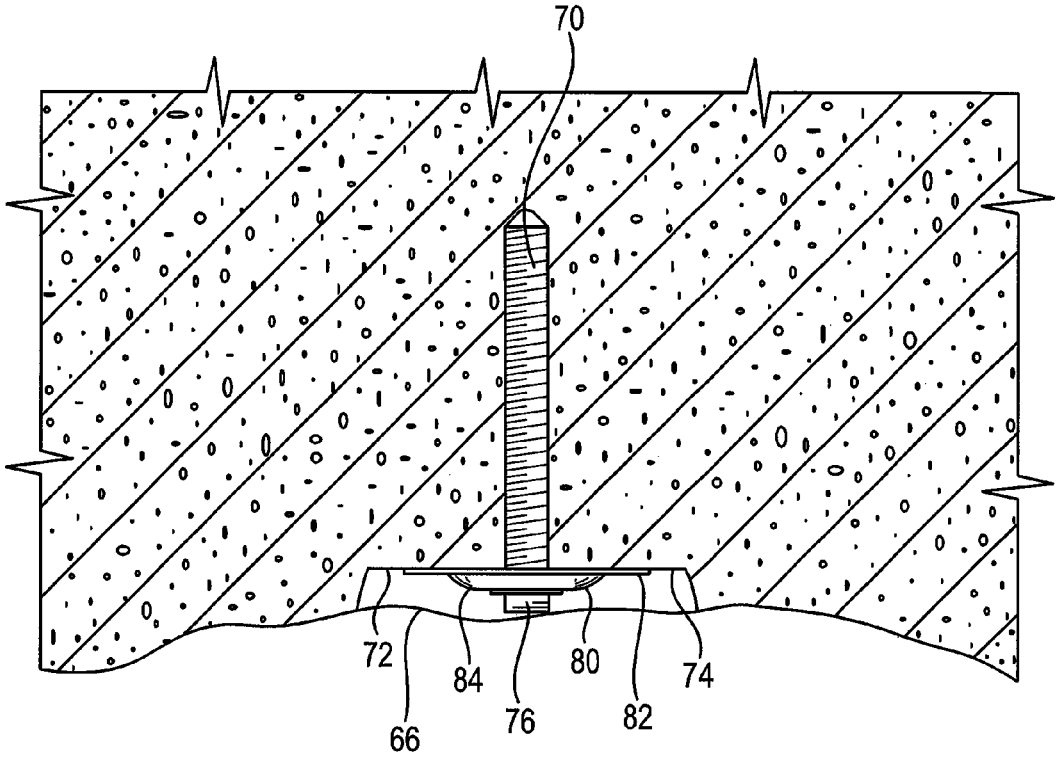
FIG. 9 is a side elevation view of a roof bolt installed using the tool of the present invention.

FIG. 9 shows the roof bolt 70 installed into the mine roof 62. The roof bolt installation tool 10 has cut a recess 72 in the mine roof 62. The recess 72 has a substantially horizontal upper surface 74. The roof bolt 70 is surrounded by a plate 80 with a flat upper surface 82 and a domed lower surface 84. The flat upper surface 80 contacts the horizontal upper surface 74 of the recess 72. The roof bolt 70 has a bolt head 76. The bolt head 76 does not project below the roof line 66.

Figure 10:
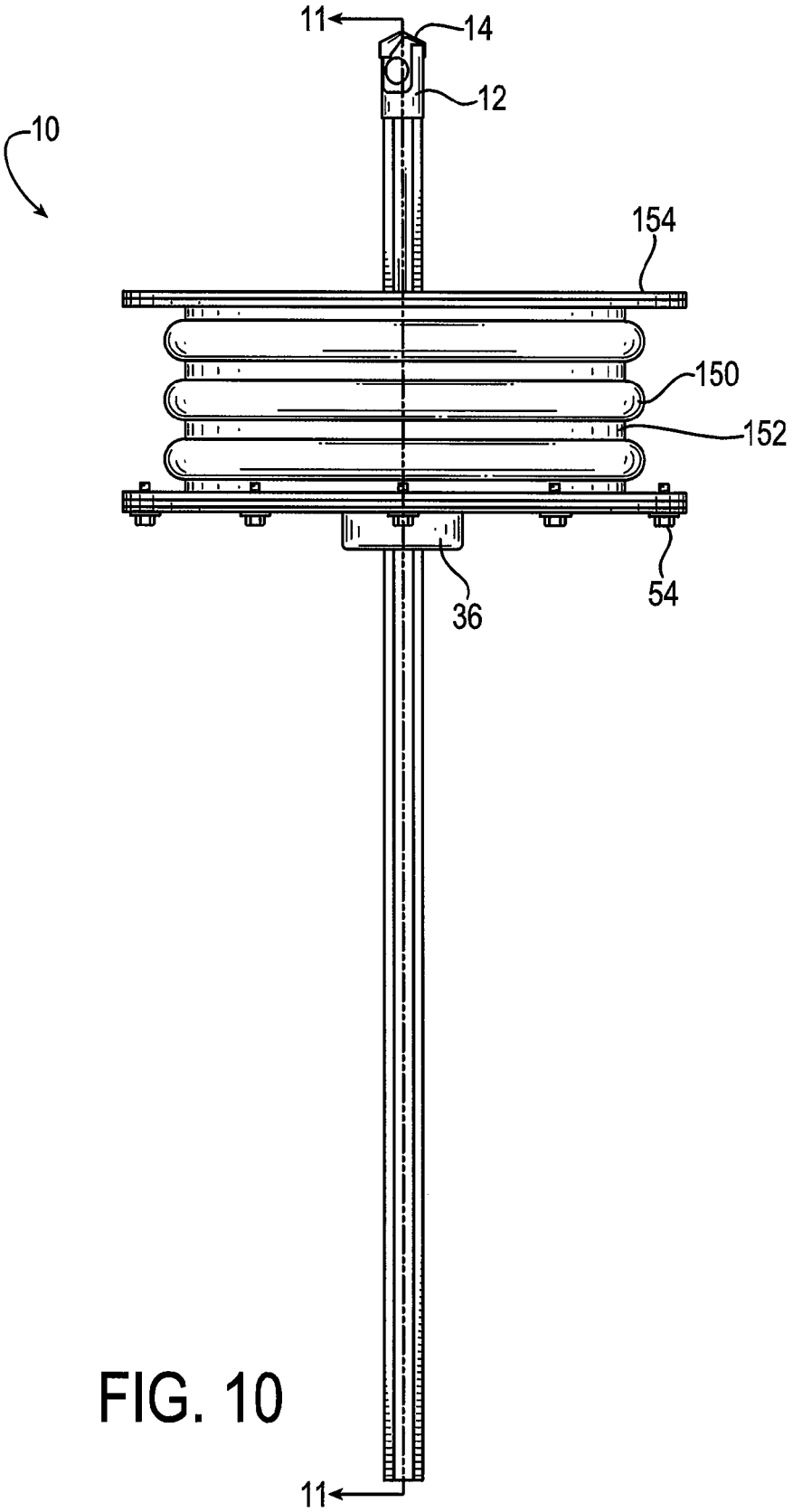
FIG. 10 is a side elevation view of the invention of FIG. showing an alternate boot.
Figure 11:
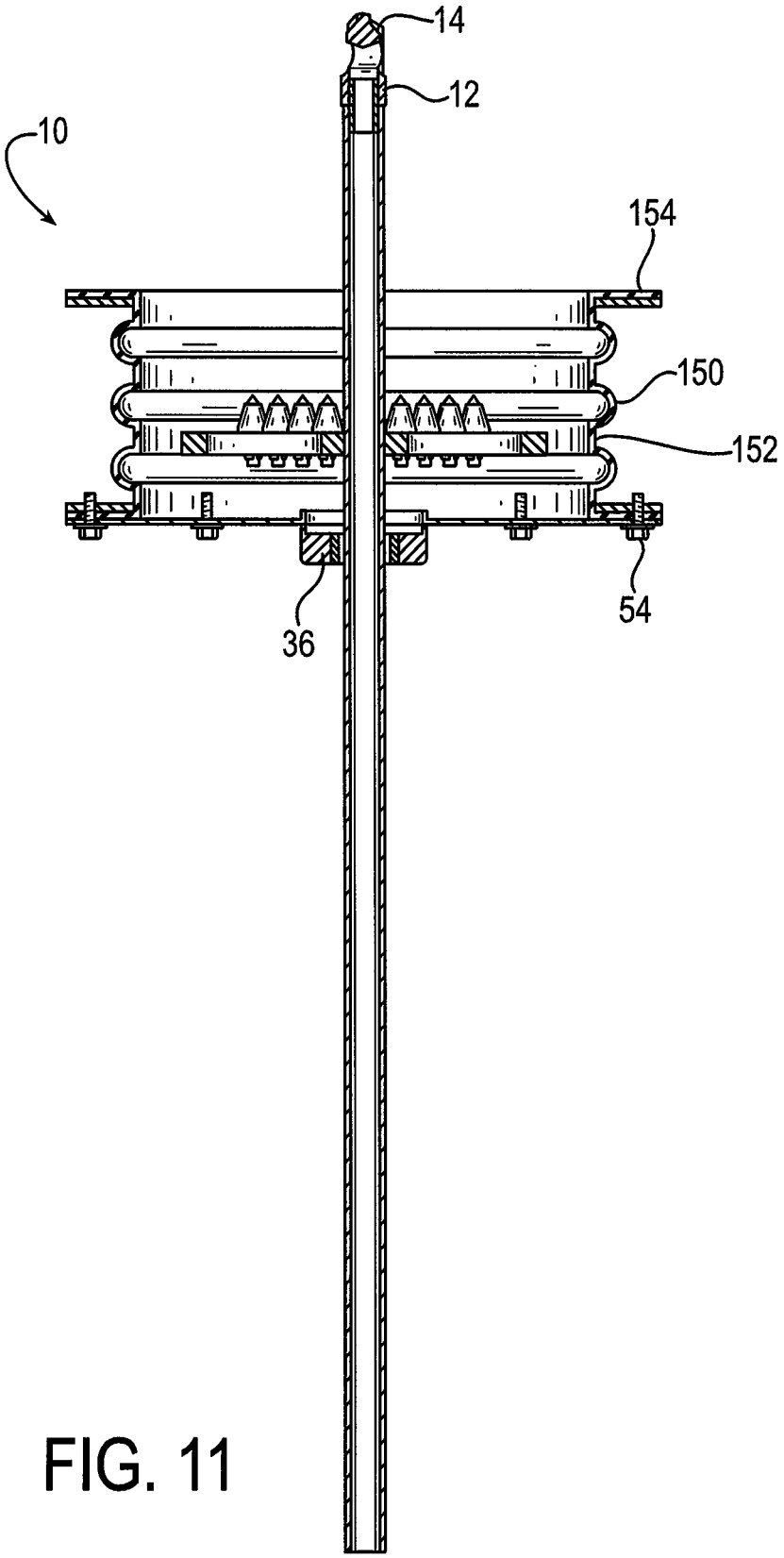
FIG. 11 is a cross-sectional view of the embodiment of FIG. 10 taken along the line 11-11 in FIG. 10.

FIGS. 10 and 11 illustrate an alternative embodiment of the boot 50. In FIGS. 10 and 11, the boot 50 has been replaced with an alternative boot 150. The alternative boot 150 includes convolutions 152 which allow the boot 150 to easily compress when it comes in contact with the mine roof 62 (as illustrated in FIG. 8 with boot 50). Upper plate 154 is designed to contact the roof 62.

As will be apparent to those skilled in the art in light of the foregoing disclosure, many alterations and modifications are possible in the practice of this invention without departing from the spirit or scope thereof.

The invention claimed is:

1. A roof bolt installation tool comprising:

a central drill bit;

a plate surrounding the central drill bit, the plate having radial drill bits attached thereto such that when the central drill bit rotates, the plate rotates, each of the radial drill bits having cutting tips being in substantially the same plane;

a boot surrounding the plate, the boot rotationally isolated from the plate and central drill bit, wherein the plate has a plurality of radial arms and wherein the radial drill bits are attached to the radial arms.

2. The roof bolt installation tool of claim 1 wherein the radial drill bits are removably attached to the radial arms of the plate.

3. The roof bolt installation tool claim 2 wherein the radial drill bits are attached to the radial arms by c-clips.

4. The roof bolt installation tool of claim 1 wherein the boot is rotationally isolated from the plate and central drill bit by a bearing, and wherein a base plate is rotationally isolated from the plate and wherein the boot is attached to the base plate.

5. The roof bolt installation tool of claim 4 wherein the boot is removably attached to the base plate.

* * * * *